US010683632B2

(12) United States Patent
Nakamura et al.

(10) Patent No.: US 10,683,632 B2
(45) Date of Patent: Jun. 16, 2020

(54) WORK VEHICLE

(71) Applicant: Hitachi Construction Machinery Co., Ltd., Taito-ku, Tokyo (JP)

(72) Inventors: Atsushi Nakamura, Hyogo (JP); Koji Shimazaki, Hyogo (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 34 days.

(21) Appl. No.: 16/094,751

(22) PCT Filed: Sep. 28, 2016

(86) PCT No.: PCT/JP2016/078738
§ 371 (c)(1),
(2) Date: Oct. 18, 2018

(87) PCT Pub. No.: WO2018/061132
PCT Pub. Date: Apr. 5, 2018

(65) Prior Publication Data

US 2019/0169817 A1 Jun. 6, 2019

(51) Int. Cl.
*E02F 3/42* (2006.01)
*E02F 3/28* (2006.01)
(Continued)

(52) U.S. Cl.
CPC ..... *E02F 3/422* (2013.01); *E02F 3/283* (2013.01); *E02F 9/22* (2013.01); *E02F 9/2225* (2013.01);
(Continued)

(58) Field of Classification Search
CPC ..... E02F 3/422; E02F 9/2066; E02F 9/2095; E02F 9/265; E02F 9/2242; E02F 9/22;
(Continued)

(56) References Cited

U.S. PATENT DOCUMENTS 6,076,488 A * 6/2000 Yamagishi ..... F01P 5/043 123/41.12
6,179,570 B1 * 1/2001 Smith ..... F04B 49/002 417/212
(Continued)

FOREIGN PATENT DOCUMENTS

JP 2009-228874 A 10/2009
JP 2010-48336 A 3/2010
JP 2015-86575 A 5/2015

OTHER PUBLICATIONS

International Search Report (PCT/ISA/210) issued in PCT Application No. PCT/JP2016/078738 dated Dec. 13, 2016 with English translation (three (3) pages).
(Continued)

*Primary Examiner* — Muhammad Shafi
(74) *Attorney, Agent, or Firm* — Crowell & Moring LLP

(57) ABSTRACT

A work vehicle includes: a main hydraulic pump that supplies pressure oil to a hydraulic cylinder; an accessory pump that supplies pressure oil to an auxiliary machine; and a confluence switching valve that merges pressure oil of the accessory pump with pressure oil of the main hydraulic pump. The work vehicle is provided with a control device that, in case atmospheric pressure or air density of outside air is lower than a predetermined value, executes confluence limitation control of reducing a confluence flow rate at the confluence switching valve compared to the time in case the atmospheric pressure or the air density of the outside air is higher than the predetermined value, and canceling the confluence limitation control in case rotation speed of an engine becomes higher compared to a predetermined rotation speed value during the confluence limitation control, and the rotation speed value is higher as the atmospheric pressure or the air density of the outside air is lower.

6 Claims, 16 Drawing Sheets

(51) Int. Cl.

| | |
|---|---|
| ***E02F 9/22*** | (2006.01) |
| ***F15B 11/042*** | (2006.01) |
| ***F02D 45/00*** | (2006.01) |
| ***F15B 11/02*** | (2006.01) |
| ***F02D 29/00*** | (2006.01) |

(52) U.S. Cl.
CPC ..... *E02F 9/2246* (2013.01); *E02F 9/2292* (2013.01); *F02D 29/00* (2013.01); *F02D 45/00* (2013.01); *F15B 11/02* (2013.01); *F15B 11/0426* (2013.01); *E02F 9/2285* (2013.01); *F02D 2200/703* (2013.01)

(58) Field of Classification Search
CPC ..... E02F 9/2225; E02F 9/2246; E02F 9/2292; E02F 3/283; E02F 9/2285; F15B 11/02; F15B 11/0426; F02D 29/04; F02D 29/00; F02D 45/00; F02D 2200/703

USPC ..... 701/50

See application file for complete search history.

(56) References Cited

U.S. PATENT DOCUMENTS

| | | | | |
|---|---|---|---|---|
| 7,958,907 | B2 * | 6/2011 | Nishikawa | E02F 9/2228 137/596.16 |
| 8,701,397 | B2 * | 4/2014 | Tanaka | E02F 9/2228 60/329 |
| 10,273,962 | B2 * | 4/2019 | Mate | F04D 25/04 |
| 2006/0090460 | A1 * | 5/2006 | Ma | E02F 9/2203 60/459 |
| 2007/0193262 | A1 * | 8/2007 | Iwamoto | B60W 10/06 60/421 |
| 2008/0034746 | A1 * | 2/2008 | Verkuilen | E02F 9/2242 60/422 |
| 2009/0090237 | A1 * | 4/2009 | Nishikawa | E02F 9/2012 91/461 |
| 2011/0011076 | A1 * | 1/2011 | Tanaka | E02F 9/2228 60/396 |
| 2015/0063967 | A1 | 3/2015 | Morita | |
| 2016/0251832 | A1 | 9/2016 | Kure | |
| 2016/0273192 | A1 * | 9/2016 | Kajita | E02F 9/2217 |

OTHER PUBLICATIONS

Japanese-language Written Opinion (PCT/ISA/237) issued in PCT Application No. PCT/JP2016/078738 dated Dec. 13, 2016 (four (4) pages).

* cited by examiner

WORK VEHICLE

TECHNICAL FIELD

The present invention relates to a work vehicle.

BACKGROUND ART

There is known a work vehicle that changes a maximum absorption torque of a hydraulic pump with respect to an actual rotation speed of an engine according to a manipulated variable of an accelerator pedal, and can improve an increase rate of a rotation speed of the engine at high altitudes without deteriorating a workability at flats (refer to Patent Literature 1).

CITATION LIST

Patent Literature

PATENT LITERATURE 1: JP-A No. 2015-086575

SUMMARY OF INVENTION

Technical Problem

In the meantime, among the work vehicles, there is one that merges a pressure oil discharged from an accessory pump for an auxiliary machine with a pressure oil discharged from a main hydraulic pump, supplies the pressure oil to an arm cylinder, and increases an operation speed of a lift arm.

In such work vehicle, when a control of merging the pressure oil discharged from the accessory pump and the pressure oil discharged from the main hydraulic pump (confluence control) is executed, a load applied to the engine increases. Therefore, when a confluence control is executed while an engine output torque is limited during the work at high altitudes and so on, there is a possibility that the engine output torque becomes insufficient, an increase rate of an engine rotation speed, namely racing of the engine deteriorates, and a work performance deteriorates.

Solution to Problem

A work vehicle according to an aspect of the present invention is a work vehicle including an engine, a working device that includes a work tool and a lift arm, a hydraulic cylinder that is for driving the working device, a main hydraulic pump that is driven by the engine and discharges pressure oil that is for driving the hydraulic cylinder, an operation device that operates the hydraulic cylinder, an accessory pump that is driven by the engine and discharges pressure oil that is for driving an auxiliary machine, and a confluence switching valve that merges pressure oil discharged from the accessory pump with pressure oil discharged from the main hydraulic pump. In the work vehicle, a rotation speed detection device and a control device are provided, the rotation speed detection device detecting rotation speed of the engine, the control device, in case atmospheric pressure or air density of the outside air is lower than a predetermined value, executing confluence limitation control of reducing a confluence flow amount at the confluence switching valve compared to the time in case the atmospheric pressure or the air density of the outside air is higher than the predetermined value, and canceling the confluence limitation control in case the rotation speed of the engine becomes higher than a predetermined rotation speed value during the confluence limitation control, and the rotation speed value is greater as the atmospheric pressure or the air density of the outside air is lower.

Advantageous Effects of Invention

According to the present invention, a racing performance of the engine is improved, and a work performance can be improved.

DESCRIPTION OF EMBODIMENTS

Figure 1:
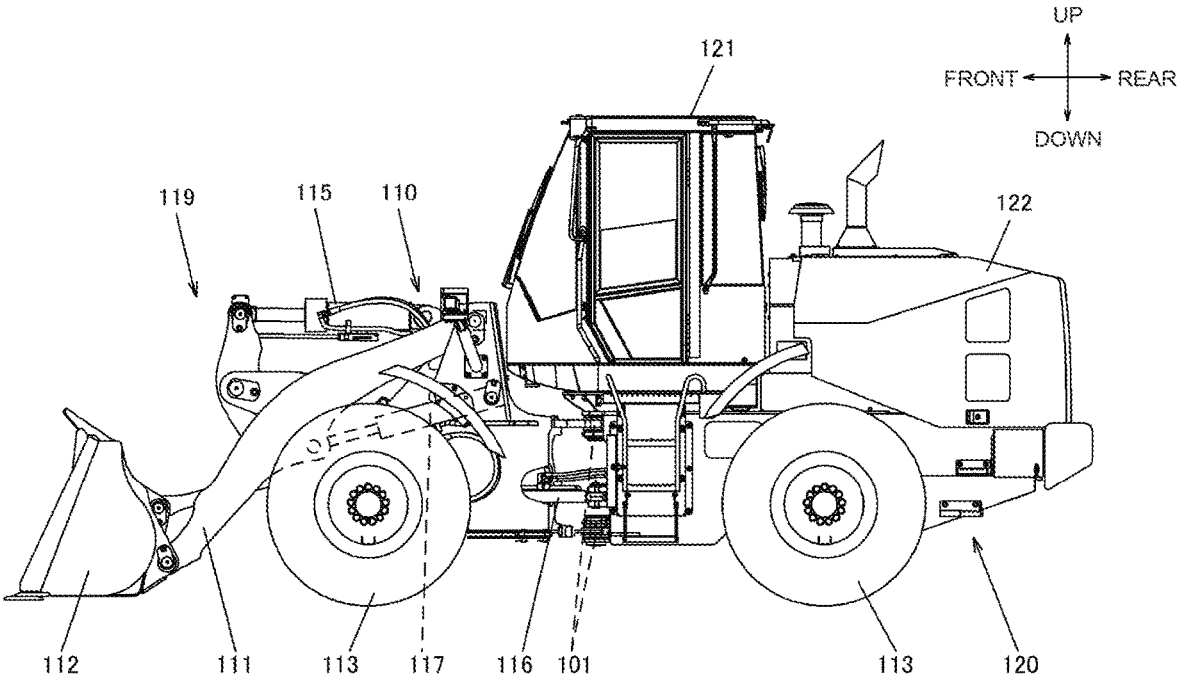
FIG. 1 is a side view of a wheel loader that is an example of a work vehicle related to an embodiment of the present invention.

Hereinafter, an embodiment of a work vehicle by the present invention will be explained referring to the drawings.

FIG. 1 is a side view of a wheel loader that is an example of a work vehicle related to an embodiment of the present invention. The wheel loader is configured with a front frame 110 that includes an arm (also referred to as a lift arm or a boom) 111, a bucket 112, wheels (front wheels) 113, and the like and a rear frame 120 that includes a cab 121, a machine chamber 122, wheels (rear wheels) 113, and the like.

The arm 111 turns (lifts) in a vertical direction by driving an arm cylinder 117, and the bucket 112 turns (crowds or dumps) in the vertical direction by driving a bucket cylinder 115. A front working device (working system) 119 that executes working such as excavation, loading/unloading, and the like is configured to include the arm 111 with the arm cylinder 117 and the bucket 112 with the bucket cylinder 115. The front frame 110 and the rear frame 120 are turnably connected to each other by a center pin 101, and the front frame 110 bends to the left and right with respect to the rear frame 120 by expansion and contraction of steering cylinders 116.

An engine is arranged in the inside of the machine chamber 122, and various operation devices such as an arm operation device that operates an accelerator pedal and the arm cylinder 117, a bucket operation device that operates the bucket cylinder 115, a steering device, and a forward/backward switch lever are arranged in the inside of the cab 121. The arm operation device and the bucket operation device are hereinafter collectively referred to and explained simply as an operation device 31 (refer to FIG. 2).

Figure 2:
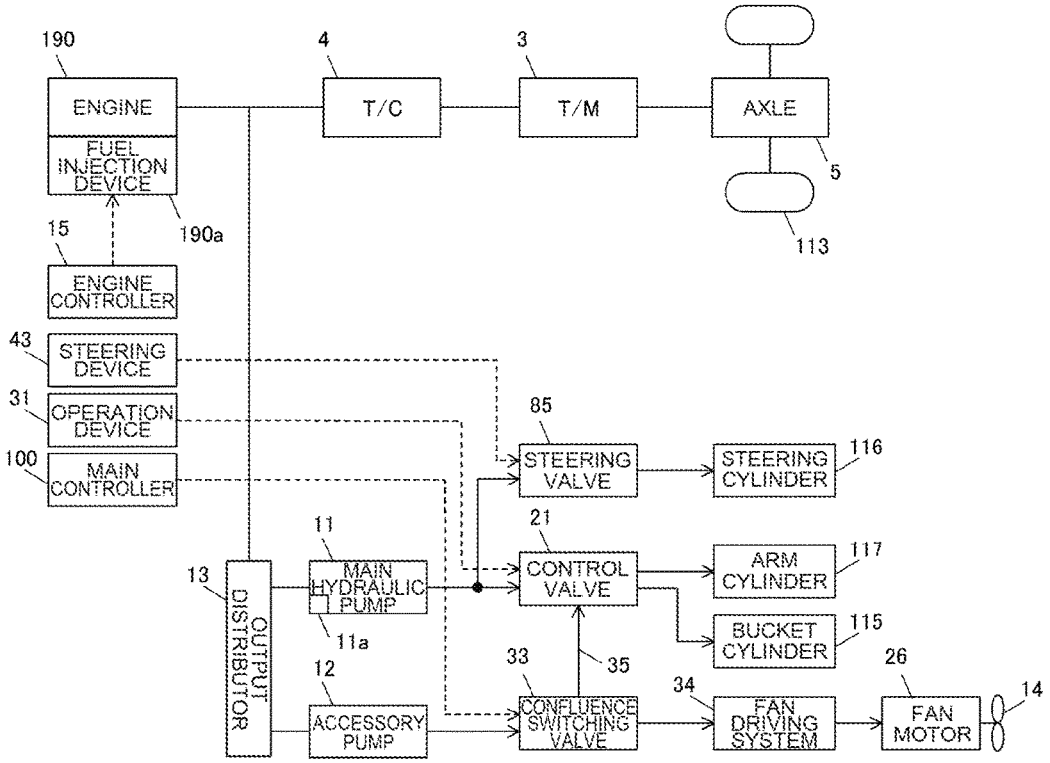
FIG. 2 is a drawing that shows a schematic configuration of the wheel loader.

FIG. 2 is a drawing that shows a schematic configuration of the wheel loader. The operation device 31 is a hydraulic pilot type operation device, and includes an operation lever that is capable of turning operation and an operation signal output device that outputs an operation signal according to a manipulated variable of the operation lever. The operation signal output device includes plural pilot valves, and outputs a pilot pressure that is an operation signal corresponding to the lifting command and lowering command for the arm 111, and the crowd command and the dump command for the bucket 112.

A steering device 43 includes a steering wheel that is capable of a turning operation and a steering signal output device that outputs a steering signal according to a manipulated variable of the steering wheel. The steering signal output device is Orbitrol (registered trade mark) for example, is connected to the steering wheel through a steering shaft, and outputs a pilot pressure that is a steering signal corresponding to the left turn command and the right turn command.

The wheel loader includes control devices such as a main controller 100 and an engine controller 15. The main controller 100 and the engine controller 15 are configured to include a storage device such as CPU, ROM, and RAM and an arithmetic processing unit that includes other peripheral circuits and the like, and control each unit (hydraulic pump, valve, engine and the like) of the wheel loader.

The wheel loader includes a travel driving device (traveling system) that transfers a drive force of an engine 190 to the wheels 113. Also, to the engine 190, a main hydraulic pump 11 and an accessory pump 12 described below are connected through an output distributor 13. The travel driving device includes a torque converter 4 that is connected to an output shaft of the engine 190, a transmission 3 that is connected to an output shaft of the torque converter 4, and an axle device 5 that is connected to an output shaft of the transmission 3.

The torque converter 4 is a fluid clutch including known impeller, turbine, and stator, and rotation of the engine 190 is transmitted to the transmission 3 through the torque converter 4. The transmission 3 includes a hydraulic clutch that shifts the speed stage of the transmission 3 to 1st speed to 4th speed, and the speed of rotation of the output shaft of the torque converter 4 is shifted by the transmission 3. Rotation after the shift is transmitted to the wheels 113 through a propeller shaft and the axle device 5, and the wheel loader travels.

The wheel loader includes the main hydraulic pump 11, the accessory pump 12, the plural hydraulic cylinders (115, 116, 117) described above, a control valve 21, a steering valve 85, and a confluence switching valve 33. The control valve 21 controls the flow of the pressure oil to the hydraulic cylinders (115, 117) for driving the working device 119. The steering valve 85 controls the flow of the pressure oil to the hydraulic cylinders (116) that are for steering the wheels 113. The plural hydraulic cylinders include the arm cylinder 117 that drives the arm 111, the bucket cylinder 115 that drives the bucket 112, and the steering cylinders 116 that bend the front frame 110 with respect to the rear frame 120. The main hydraulic pump 11 for driving the working device is driven by the engine 190, sucks the hydraulic oil inside a hydraulic oil tank, and discharges the hydraulic oil as the pressure oil.

The main hydraulic pump 11 is a variable displacement hydraulic pump of a swash plate type or a bent axis type in which the displacement volume is changed. The discharge flow rate of the main hydraulic pump 11 is determined according to the displacement volume and the rotation speed of the main hydraulic pump 11. A regulator 11*a* adjusts the displacement volume so that the absorption torque (input torque) of the main hydraulic pump 11 does not exceed the maximum pump absorption torque that is set by the main controller 100. As described below, the characteristic (set value) of the maximum pump absorption torque is changed according to the air density $\rho$.

The pressure oil discharged from the main hydraulic pump 11 is supplied to the arm cylinder 117 and the bucket cylinder 115 through the control valve 21, and the arm 111 and the bucket 112 are driven by the arm cylinder 117 and the bucket cylinder 115. The control valve 21 is operated by a pilot pressure outputted from an operation signal output device of the operation device 31, and controls the flow of the pressure oil from the main hydraulic pump 11 to the arm cylinder 117 and the bucket cylinder 115. Thus, the arm cylinder 117 and the bucket cylinder 115 configuring the working device 119 are driven by the pressure oil discharged from the main hydraulic pump 11.

The pressure oil discharged from the main hydraulic pump 11 is supplied to a left and right pair of the steering cylinders 116 through the steering valve 85, and the front frame 110 is bent and steered to the left and right with respect to the rear frame 120 by a left and right pair of the steering cylinders 116. The steering valve 85 is operated by a pilot pressure outputted from a steering signal output device of the steering device 43, and controls the flow of the pressure oil from the main hydraulic pump 11 to the steering cylinders 116. Thus, the steering cylinders 116 that configure a traveling device are driven by the pressure oil discharged from the main hydraulic pump 11.

The accessory pump 12 is driven by the engine 190, draws the hydraulic oil of the inside of the hydraulic oil tank, and discharges the hydraulic oil as the pressure oil for driving the auxiliary machines. The accessory pump 12 supplies the hydraulic oil to a fan motor 26 through the confluence switching valve 33 and a fan driving system 34. The fan motor 26 is a drive source driving a cooling fan 14 that blows the cooling air to heat exchangers of a radiator (not illustrated) and an oil cooler (not illustrated) for the engine 190, a working fluid cooler (not illustrated), and so on. The fan driving system 34 controls the supply amount of the hydraulic oil to the fan motor 26. The fan driving system 34 includes a variable relief valve (not illustrated) for adjusting the rotation speed of the fan motor 26, a check valve (not illustrated) for preventing cavitation when a hydraulic circuit for driving the fan motor 26 reaches a negative pressure, and so on. The cooling fan 14, the fan motor 26, and the fan driving system 34 configure a fan device that is one of the plural auxiliary machines.

The hydraulic oil discharged from the accessory pump 12 is supplied also to an operation signal output device of the operation device 31 and a steering signal output device of the steering device 43, the operation signal output device and the steering signal output device being auxiliary machines. The operation signal output device of the operation device 31 reduces pressure of the hydraulic oil discharged from the accessory pump 12, and outputs a pilot pressure according to the manipulated variable of the operation lever to a pilot pressure receiving section of the control valve 21. The steering signal output device of the steering device 43 reduces pressure of the hydraulic oil discharged from the accessory pump 12, and outputs a pilot pressure according to the manipulated variable of the steering wheel to a pilot pressure receiving section of the steering valve 85. Thus, the fan motor 26, the operation signal output device of the operation device 31, and the steering signal output device of the steering device 43 are driven by the hydraulic oil discharged from the accessory pump 12, the fan motor 26, the operation signal output device, and the steering signal output device being the auxiliary machines.

The confluence switching valve 33 is an electromagnetic switching valve that merges the hydraulic oil discharged from the accessory pump 12 with the hydraulic oil discharged from the main hydraulic pump 11, and is connected to the control valve 21 by a confluence line 35. Also, the confluence line 35 is not necessarily required to be connected to the control valve 21, and may be configured to be connected to a supply line between the control valve 21 and the arm cylinder 117 in a state of arranging a valve separately.

The confluence switching valve 33 is switched between a normal position for guiding the entire pressure oil discharged from the accessory pump 12 to the fan motor 26 through the fan driving system 34 and a confluence position for guiding the entire pressure oil discharged from the accessory pump 12 to the arm cylinder 117 through the control valve 21. The confluence switching valve 33 is controlled based on a control signal from the main controller 100.

In the confluence switching valve 33, a solenoid (not illustrated) is arranged. The confluence switching valve 33 is switched between the normal position and the confluence position based on a control signal (excitation current) outputted from the main controller 100 to the solenoid. Further, it may also be configured that, in being switched to the confluence position, the confluence switching valve 33 does not guide the entire hydraulic oil discharged from the accessory pump 12 to the control valve 21 but to guide a part of the hydraulic oil to the control valve 21.

Because the main hydraulic pump 11 is connected to the engine 190 as described above, a load comes to be applied to the engine 190 in driving the hydraulic cylinders (115, 117) that configure the working device 119 and in driving the hydraulic cylinders (116) that configure the traveling device. Because the accessory pump 12 is connected to the engine 190 as described above, a load comes to be applied to the engine 190 in driving the fan device and in driving the working device 119 during the confluence control. Because the travel driving device is connected to the engine 190 as described above, a travel load from the travel driving device is also applied. The output torque characteristic of the engine 190 is set to have a predetermined margin so that an engine stall does not occur when various loads are applied in executing a work at flats. Also, in the present description, "flats" is defined to be a flat ground of 0 m altitude.

Figure 3:
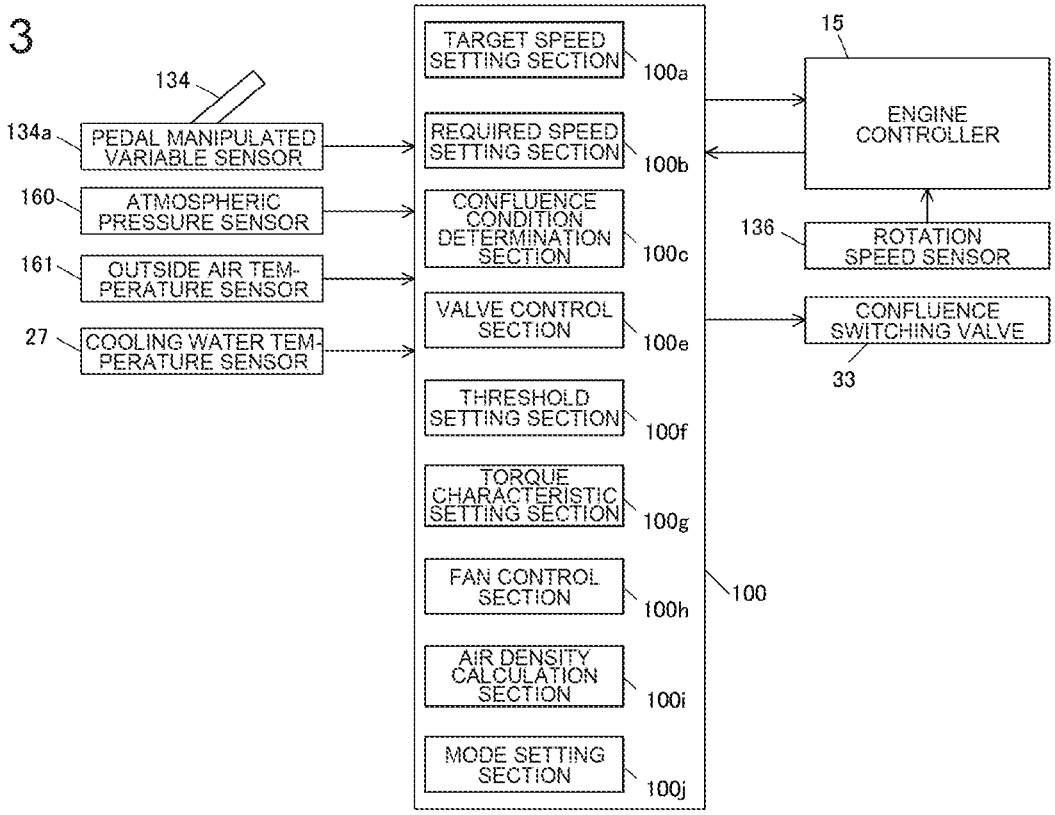
FIG. 3 is a functional block diagram of a main controller.

FIG. 3 is a functional block diagram of the main controller 100. The main controller 100 functionally includes a target speed setting section 100*a*, a required speed setting section 100*b*, a confluence condition determination section 100*c*, a valve control section 100*e*, a threshold setting section 100*f*, a torque characteristic setting section 100*g*, a fan control section 100*h*, an air density calculation section 100*i*, and a mode setting section 100*j*.

To the main controller 100, an atmospheric pressure sensor 160 and an outside air temperature sensor 161 are connected. The atmospheric pressure sensor 160 detects the atmospheric pressure, and outputs a detection signal to the main controller 100. The outside air temperature sensor 161 detects the outside air temperature, and outputs a detection signal to the main controller 100.

The air density calculation section 100*i* calculates the air density ρ (kg/m$^3$) of the outside air based on the atmospheric pressure P (hPa) detected by the atmospheric pressure sensor 160 and the outside air temperature t (° C.) detected by the outside air temperature sensor 161. The air density ρ is obtained by an equation of state (1) with R being the gas constant of the dry air.

$$\rho = P/\{R(t+273.15)\} \quad (1)$$

To the main controller 100, a pedal manipulated variable sensor 134*a* is connected. The pedal manipulated variable sensor 134*a* detects the stepping manipulated variable of an accelerator pedal 134, and outputs a detection signal to the main controller 100. The target speed setting section 100*a* sets the target rotation speed of the engine 190 according to the manipulated variable of the accelerator pedal 134 detected by the pedal manipulated variable sensor 134*a*. Hereinafter, the target rotation speed of the engine 190 is also referred to as the target engine rotation speed Nt.

Figure 4:
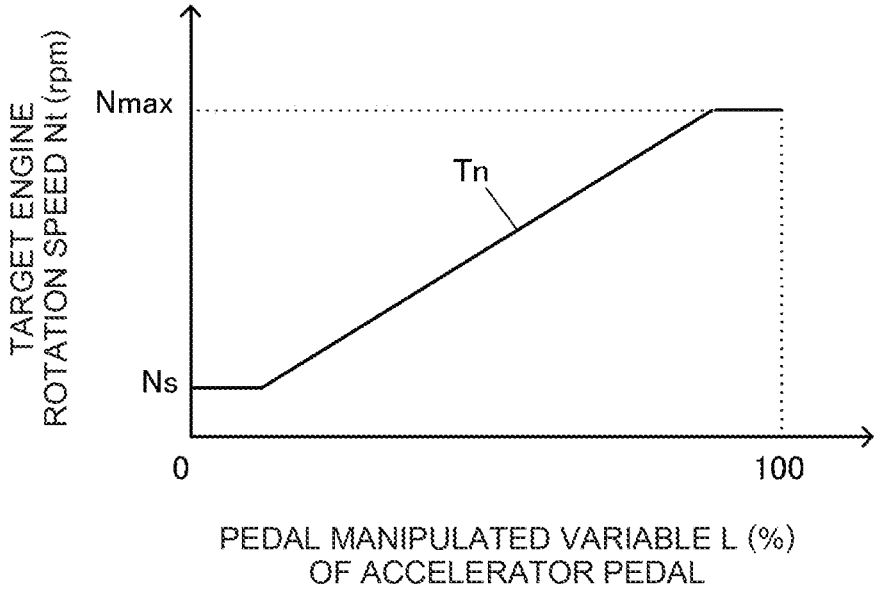
FIG. 4 is a drawing that shows the relation between a manipulated variable L of an accelerator pedal and the target engine rotation speed Nt.

FIG. 4 is a drawing that shows the relation between the manipulated variable L of the accelerator pedal 134 and the target engine rotation speed Nt. In a storage device of the main controller 100, a table of the characteristic Tn of the target engine rotation speed with respect to the manipulated variable L shown in FIG. 4 is stored. The target speed setting section 100*a* refers to the table of the characteristic Tn, and sets the target engine rotation speed Nt based on the manipulated variable L detected by the pedal manipulated variable sensor 134*a*. The target engine rotation speed Nt at the time of not operating the accelerator pedal 134 (0%) is set to the lowest rotation speed (low idle rotation speed) Ns. As the pedal manipulated variable L of the accelerator pedal 134 increases, the target engine rotation speed Nt increases. The target engine rotation speed Nt at the time of stepping the pedal at maximum (100%) becomes the maximum rotation speed Nmax.

The required speed setting section 100*b* shown in FIG. 3 executes correction so that, as the air density ρ of the outside air becomes lower, the target engine rotation speed Nt set by the target speed setting section 100*a* is increased, and sets the target engine rotation speed Nt after the correction as a required engine rotation speed Nr. Further, there is also a case that the correction amount is made 0 and the target engine rotation speed Nt is set as the required engine rotation speed Nr as it is.

Figure 5:
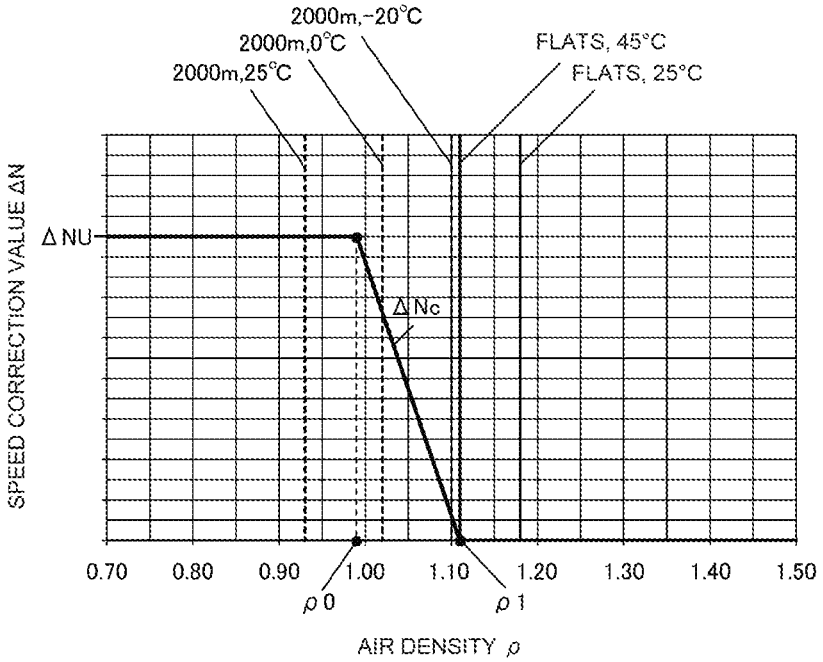
FIG. 5 is a drawing that shows the relation between the air density ρ of an outside air and a speed correction value ΔN.

FIG. 5 is a drawing that shows the relation between the air density ρ of the outside air and the speed correction value ΔN. In the storage device of the main controller 100, a table of the correction characteristic ΔNc that is a characteristic of the speed correction value ΔN with respect to the air density ρ shown in FIG. 5 is stored. The required speed setting section 100*b* refers to the table of the correction characteristic ΔNc, and calculates the speed correction value ΔN based on the air density ρ of the outside air calculated by the air density calculation section 100*i*. The required speed setting section 100*b* executes a speed increase correction of adding the speed correction value ΔN to the target engine rotation speed Nt set by the target speed setting section 100*a*, and sets the target engine rotation speed Nt after the correction as the required engine rotation speed Nr (Nr=Nt+ΔN).

The correction characteristic ΔNc is set as described below. When the air density ρ is ρ0 or below, the speed correction value ΔN becomes an upper limit value ΔNU. When the air density ρ is in a rage higher than ρ0 and below ρ1, the speed correction value ΔN lowers accompanying increase of the air density ρ. When the air density ρ is ρ1 or above, the speed correction value ΔN becomes 0 (lower limit value). That is to say, the speed correction value ΔN changes between the upper limit value ΔNU and 0 (lower limit value) by change of the air density ρ. ρ0 is a value higher than the air density at the altitude of 2,000 m and the air temperature of 25° C. and lower than the air density at the altitude of 2,000 m and the air temperature of 0° C. ρ1 is a value higher than the air density at the altitude of 2,000 m and the air temperature of −20° C. and lower than the air density of the flats at the air temperature of 25° C. In the present embodiment, ρ1 is set to the air density of the flats at the air temperature of 45° C.

As shown in FIG. 3, the main controller 100 outputs a control signal corresponding to the required engine rotation speed Nr to the engine controller 15. To the engine controller 15, a rotation speed sensor 136 is connected. The rotation speed sensor 136 detects an actual rotation speed of the engine 190 (will be hereinafter also referred to as an actual engine rotation speed Na), and outputs a detection signal to the engine controller 15. Also, the engine controller 15 outputs information of the actual engine rotation speed Na to the main controller 100. The engine controller 15 compares the required engine rotation speed Nr from the main controller 100 and the actual engine rotation speed Na detected by the rotation speed sensor 136 to each other, and controls a fuel injection device 190*a* (refer to FIG. 2) so that the actual engine rotation speed Na becomes the required engine rotation speed Nr.

Figure 6:
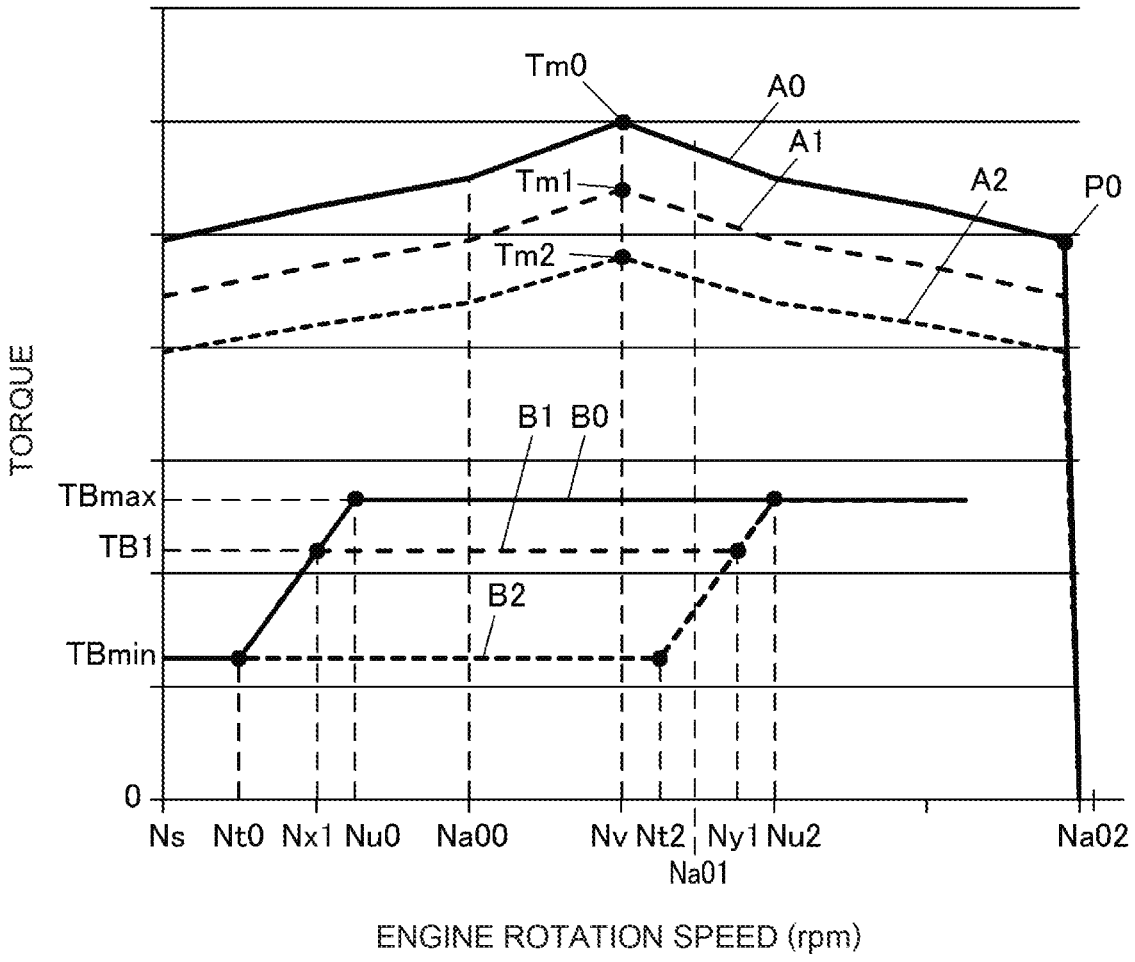
FIG. 6 is a torque diagram of the wheel loader.

FIG. 6 is a torque diagram of the wheel loader, and shows the relation between the engine rotation speed and the torque when the accelerator pedal 134 is stepped to the maximum. FIG. 6 shows the output torque characteristic of the engine 190 and the pump absorption torque characteristic of the main hydraulic pump 11. In the storage device of the main controller 100, plural engine out put torque characteristics A0, A1, A2 and plural pump absorption torque characteristics B0, B1, B2 are stored in a look-up table form. As described below, the characteristics A0, B0 are used when the air density ρ is a first density threshold ρp1 or more (non-limitation mode), the characteristics A1, B1 are used when the air density ρ is less than the first density threshold ρp1 and a second density threshold ρp2 or more (first limitation mode), and the characteristics A2, B2 are used when the air density ρ is less than the second density threshold ρp2 (second limitation mode).

The engine output torque characteristics A0, A1, A2 respectively show the relation between the engine rotation speed and the maximum engine output torque. Also, the engine output torque means a torque the engine 190 can output at each rotation speed. The region defined by the engine output torque characteristic shows the performance the engine 190 can exhibit.

As shown in FIG. 6, with the engine output torque characteristic A0, the torque increases according to increase of the engine rotation speed when the engine rotation speed is in a range of the lowest rotation speed (low idle rotation speed) Ns or more and Nv or less, and becomes a maximum torque Tm0 (maximum torque point) in the characteristic A0 when the engine rotation speed is Nv. In other words, Nv is the rotation speed of the engine 190 at the maximum torque point. Also, the low idle rotation speed is the engine rotation speed of the time the accelerator pedal 134 is not operated. With the engine output torque characteristic A0, when the engine rotation speed becomes higher than Nv, the torque reduces according to increase of the engine rotation speed, and the rated output is obtained upon reaching the rated point P0.

The engine output torque characteristic A1 is a characteristic in which the torque is limited compared to the engine output torque characteristic A0, and the maximum torque Tm1 at the engine rotation speed Nv is less than Tm0 (Tm1<Tm0). The engine output torque characteristic A2 is a characteristic in which the torque is limited compared to the engine output torque characteristic A1, and the maximum torque Tm2 at the engine rotation speed Nv is less than Tm1 (Tm2<Tm1).

The pump absorption torque characteristics B0, B1, B2 respectively show the relation between the engine rotation speed and the maximum pump absorption torque (maximum pump input torque). With the pump absorption torque characteristic B0, the torque becomes a minimum value TBmin regardless of the engine rotation speed when the engine rotation speed is in a range of the lowest rotation speed Ns or more and less than Nt0. With the characteristic B0, when the engine rotation speed is Nu0 or more, the torque becomes a maximum value TBmax regardless of the engine rotation speed. With the characteristic B0, when the engine rotation speed is in a range of Nt0 or more and less than Nu0, the torque gradually increases according to increase of the engine rotation speed. The magnitude relation of Ns, Nt0, Nu0 is Ns<Nt0<Nu0.

With the pump absorption torque characteristic B2, the torque becomes the minimum value TBmin regardless of the engine rotation speed when the engine rotation speed is in a range of the lowest rotation speed Ns or more and less than Nt2. With the characteristic B2, when the engine rotation speed becomes Nu2 or more, the torque becomes the maximum value TBmax regardless of the engine rotation speed. With the characteristic B2, when the engine rotation speed is in a range of Nt2 or more and less than Nu2, the torque gradually increases according to increase of the engine rotation speed. The magnitude relation of Ns, Nt2, Nu2 is Ns<Nt2<Nu2. Nt2 is larger than Nt0 (Nt2>Nt0), and Nu2 is larger than Nu0 (Nu2>Nu0).

The pump absorption torque characteristic B1 is a same characteristic to the characteristic B0 when the engine rotation speed is in a range of the lowest rotation speed Ns or more and less than Nx1. With the characteristic B1, when the engine rotation speed is in a range of Nx1 or more and less than Ny1, the torque becomes TB1 regardless of the engine rotation speed. The magnitude relation of TBmin, TB1, TBmax is TBmin<TB1<TBmax. With the characteristic B1, when the engine rotation speed is Nu2 or more, the torque becomes the maximum value TBmax regardless of the engine rotation speed. With the characteristic B1, when the engine rotation speed is in a range of Ny1 or more and less than Nu2, the torque gradually increases according to increase of the engine rotation speed. The magnitude relation of Ns, Nt0, Nx1, Ny1, Nu2 is Ns<Nt0<Nx1<Ny1<Nu2. Nx1 is larger than Nt0 and less than Nu0 (Nt0<Nx1<Nu0). Ny1 is larger than Nt2 and less than Nu2 (Nt2<Ny1<Nu2).

The pump absorption torque characteristic B1 is a characteristic in which the torque is limited compared to the pump absorption torque characteristic B0, and the pump absorption torque characteristic B2 is a characteristic in which the torque is limited compared to the pump absorption torque characteristic B1. For example, when the engine rotation speed is in a range of Nu0 or more and less than Nt2, the maximum absorption torque is made TBmax in the characteristic B0, the maximum absorption torque is made TB1 in the characteristic B1, and the maximum absorption torque is made TBmin in the characteristic B2. Also, the engine rotation speed Nv at the maximum torque point is positioned between Nu0 and Nt2 (Nu0<Nv<Nt2).

As shown in FIG. 3, the mode setting section 100*j* determines whether or not the air density ρ calculated by the air density calculation section 100*i* is the first density threshold ρp1 or more, and whether or not the air density ρ is the second density threshold ρp2 or more. When the air density ρ is the first density threshold ρp1 or more, the mode setting section 100*j* determines that the wheel loader is located at "flats", and sets the non-limitation mode (refer to FIG. 13). When the air density ρ is less than the first density threshold ρp1 and the second density threshold ρp2 or more, the mode setting section 100*j* sets the first limitation mode (refer to FIG. 13). When the air density ρ is less than the second density threshold ρp2, the mode setting section 100*j* sets the second limitation mode (refer to FIG. 13). The first density threshold ρp1 and the second density threshold ρp2 that is smaller than the first density threshold ρp1 (ρp1>ρp2) are determined beforehand, and are stored in the storage device of the main controller 100. The first density threshold ρp1 is a threshold used for determining that the wheel loader is located at "flats", and a value of the air density at the air temperature of 25° C. and the altitude of 0 m for example is employed. The second density threshold ρp2 is a threshold used for determining that the wheel loader is located at "high altitudes", and a value of the air density at the air temperature of 25° C. and the altitude of 1,500 m for example is employed.

The torque characteristic setting section 100*g* selects the engine output torque characteristic according to a mode set by the mode setting section 100*j*, and selects the pump absorption torque characteristic. When the non-limitation mode has been set by the mode setting section 100*j*, the torque characteristic setting section 100*g* selects the engine output torque characteristic A0 and the pump absorption torque characteristic B0. When the first limitation mode has been set by the mode setting section 100*j*, the torque characteristic setting section 100*g* selects the engine output torque characteristic A1 and the pump absorption torque characteristic B1. When the second limitation mode has been set by the mode setting section 100*j*, the torque characteristic setting section 100*g* selects the engine output torque characteristic A2 and the pump absorption torque characteristic B2.

The confluence condition determination section 100*c* determines whether or not the air density ρ is less than a density threshold ρs1. When the air density ρ is less than the density threshold ρs1 (ρ<ρs1), the confluence condition determination section 100*c* determines that the confluence condition has been satisfied. When the air density ρ is the density threshold ρs1 or more (ρ≥ρs1), the confluence condition determination section 100*c* determines that the confluence condition has not been satisfied. The density threshold ρs1 is a threshold used for determining that the wheel loader is located at "high altitudes", and a value of the air density at the air temperature of 25° C. and the altitude of 1,500 m for example is employed. Also, the density threshold ρs1 and the second density threshold ρp2 are not limited to a case of being made a same value, but may be values different from each other.

When it is determined that the confluence limitation condition has been satisfied by the confluence condition determination section 100*c*, the valve control section 100*e* executes confluence limitation control of reducing the confluence flow rate in the confluence switching valve 33. The confluence limitation control is such control that the valve control section 100*e* demagnetizes the solenoid of the confluence switching valve 33 and switches the confluence switching valve 33 to the normal position.

When the actual engine rotation speed Na has become higher compared to a speed threshold (rotation speed value) Na0 during the confluence limitation control, the confluence condition determination section 100*c* determines that the limitation cancellation condition has been satisfied. When it is determined by the confluence condition determination section 100*c* that the limitation cancellation condition has been satisfied, the valve control section 100*e* executes the limitation cancellation control of exciting the solenoid of the confluence switching valve 33 and switching the confluence switching valve 33 to the confluence position.

With respect to the speed threshold Na0, plural values are determined beforehand, and are stored in the storage device. With respect to the speed threshold Na0, as the air density ρ of the outside air is lower, a higher value is set. In the storage device of the main controller 100, plural values Na00, Na01, Na02 are stored. The threshold setting section 100*f* determines the speed threshold Na0 according to a mode set by the mode setting section 100*j*. When the non-limitation mode has been set by the mode setting section 100*j* (ρ≥ρp1), the threshold setting section 100*f* selects the value Na00 for the speed threshold Na0. When the first limitation mode has been set by the mode setting section 100*j* (ρp1>p≥ρp2), the threshold setting section 100*f* selects the value Na01 for the speed threshold Na0. When the second limitation mode has been set by the mode setting section 100*j* (ρ<ρp2), the threshold setting section 100*f* selects the value Na02. The magnitude relation of the plural values Na00, Na01, Na02 is Na00<Na01<Na02.

Figure 13:
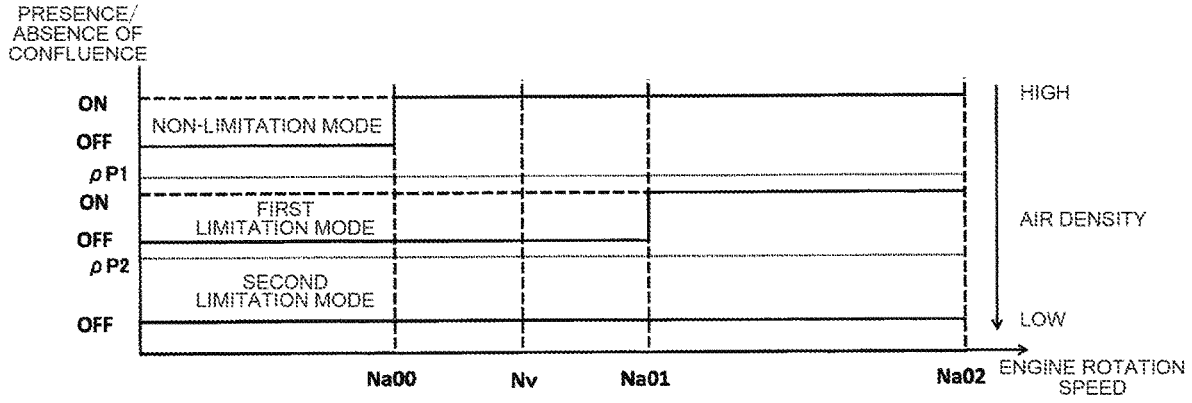
FIG. 13 is a drawing that explains a switching control of the confluence switching valve in each mode.

FIG. 13 is a drawing that explains switching control of the confluence switching valve in each mode. In FIG. 13, the horizontal axis shows the engine rotation speed. When the non-limitation mode has been set, an off-signal has been outputted from the main controller 100 to the confluence switching valve 33, and the confluence switching valve 33 has been switched to the normal position, if the engine rotation speed becomes higher than Na00, the confluence limitation control is cancelled. That is to say, an on-signal is outputted from the main controller 100 to the confluence switching valve 33, and the confluence switching valve 33 is switched to the confluence position. When the first limiting mode has been set, an off-signal has been outputted from the main controller 100 to the confluence switching valve 33, and the confluence switching valve 33 has been switched to the normal position, if the engine rotation speed becomes higher than Na01, the confluence limitation control is cancelled. That is to say, an on-signal is outputted from the main controller 100 to the confluence switching valve 33, and the confluence switching valve 33 is switched to the confluence position. When the second limitation mode has been set, an off-signal has been outputted from the main controller 100 to the confluence switching valve 33, and the confluence switching valve 33 has been switched to the normal position, if the engine rotation speed becomes higher than Na02, the confluence limitation control is cancelled. That is to say, an on-signal is outputted from the main controller 100 to the confluence switching valve 33, and the confluence switching valve 33 is switched to the confluence position.

As shown in FIG. 6, the value Na00 used at the time of the non-limitation mode is a value less than the rotation speed Nv of the engine 190 at the maximum torque point. On the other hand, the value Na01 used at the time of the first limitation mode and the value Na02 used at the time of the second limitation mode are values equal to or greater than the rotation speed Nv of the engine 190 at the maximum torque point respectively. Also, the value Na02 is a value higher than the maximum rotation speed Nmax (Nmax<Na02). That is to say, when the second limitation mode has been set, even when the actual engine rotation speed Na may become the maximum rotation speed Nmax, the confluence limitation control is not cancelled.

Figure 7:
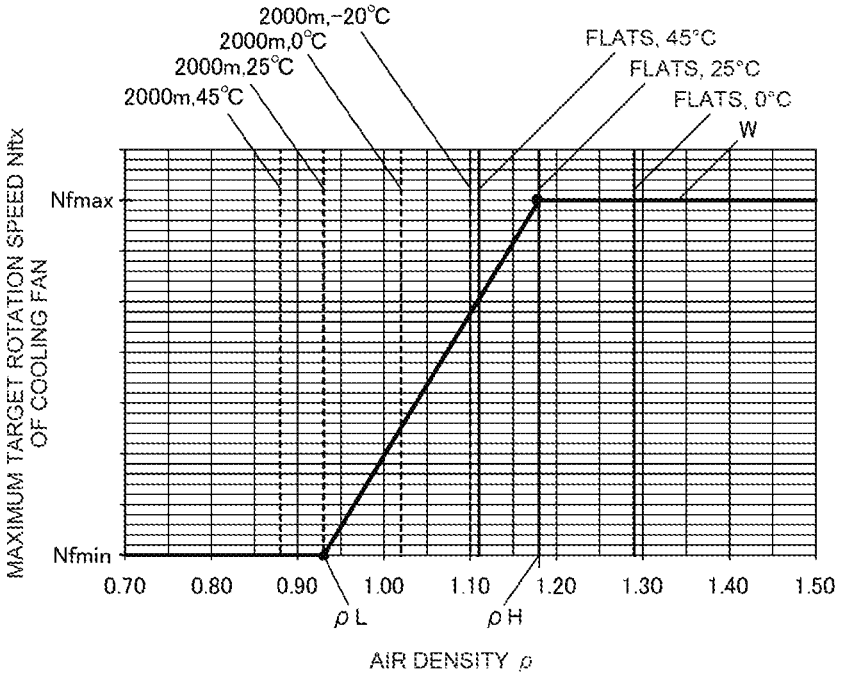
FIG. 7 is a drawing that shows the relation between the air density ρ of the outside air and a maximum target rotation speed Nftx of a cooling fan.

FIG. 7 is a drawing that shows the relation between the air density ρ of the outside air and the maximum target rotation speed Nftx of the cooling fan 14. In the storage device of the main controller 100, there is stored a table of the control characteristic W for lowering the maximum target rotation speed Nftx of the cooling fan 14 as the air density ρ of the outside air becomes lower. The fan control section **100*h* (refer to FIG. 3) refers to this table of the control characteristic W, and sets the maximum target rotation speed Nftx of the cooling fan 14 based on the air density ρ calculated by the air density calculation section 100*i***.

The control characteristic W is set so that the maximum target rotation speed Nftx is made a minimum value Nfmin when the air density ρ is ρL or below (ρ≤ρL), and the maximum target rotation speed Nftx is made a maximum value Nfmax when the air density ρ is pH or above (ρH≤ρ). The control characteristic W is set so that, when the air density ρ is in a range of higher than ρL and lower than ρH (ρL<ρ<ρH), the maximum target rotation speed Nftx is increased linearly from the minimum value Nfmin (800 rpm for example) to the maximum value Nfmax (1,500 rpm for example) accompanying increase of the air density ρ.

ρL is a value higher than the air density at the altitude of 2,000 m and the air temperature of 45° C. and lower than the air density at the altitude of 2,000 m and the air temperature of 0° C. In the present embodiment, ρL is set to the air density at the altitude of 2,000 m and the air temperature of 25° C. pH is higher than the air density of the flats at the air temperature of 45° C. and lower than the air density of the flats at the air temperature of 0° C. In the present embodiment, pH is set to the air density of the flats of the air temperature of 25° C.

Figure 16:
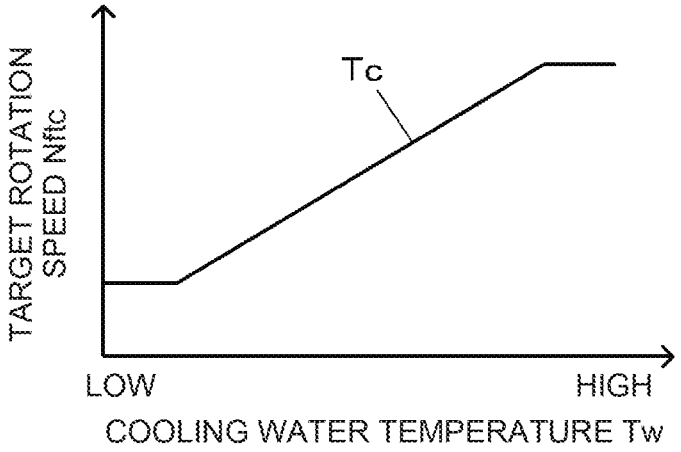
FIG. 16 is a drawing that shows a control characteristic Tc in which a cooling water temperature Tw and a target rotation speed Nftc of the cooling fan are associated with each other.

As shown in FIG. 3, to the main controller 100, a cooling water temperature sensor 27 is connected. The cooling water temperature sensor 27 detects temperature Tw of the engine cooling water, and outputs a detection signal to the main controller 100. FIG. 16 is a drawing that shows a control characteristic Tc in which the cooling water temperature Tw and the target rotation speed Nftc of the cooling fan 14 are associated with each other. In the storage device of the main controller 100, there is stored a table of a control characteristic Tc for controlling the target rotation speed Nftc of the cooling fan 14 based on the cooling water temperature Tw. The fan control section **100*h* (refer to FIG. 3) refers to this table of the control characteristic Tc, and sets the target rotation speed Nftc of the cooling fan 14 based on the cooling water temperature Tw detected by the cooling water temperature sensor 27**.

The fan control section **100*h* compares the maximum target rotation speed Nftx set based on the air density ρ and the target rotation speed Nftc calculated based on the cooling water temperature Tw to each other, and determines whether or not the maximum target rotation speed Nftx is the maximum target rotation speed Nftx or above. When the target rotation speed Nftc is the maximum target rotation speed Nftx or above, the fan control section 100*h* sets the maximum target rotation speed Nftx for a target speed Nft (Nft=Nftx). When the target rotation speed Nftc is below the maximum target rotation speed Nftx, the fan control section 100*h*** sets the target rotation speed Nftc for the target speed Nft (Nft=Nftc).

Figure 14A:
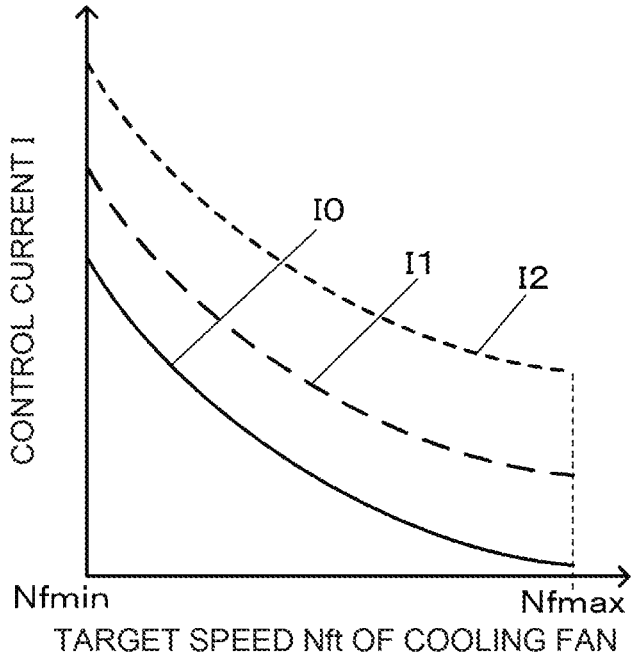
FIG. 14A is a drawing that shows a relation between a target speed Nft of the cooling fan and a control current I supplied to a solenoid of a variable relief valve

FIG. 14A is a drawing that shows the relation between the target speed Nft of the cooling fan and the control current (a target speed command signal for the cooling fan 14) I supplied to the solenoid of the variable relief valve of the fan driving system 34. Although it is not illustrated, the variable relief valve is an electromagnetic proportional valve controlled based on the control current I, and is arranged in a flow passage that connects an inlet side pipe line and an outlet side pipe line of the fan motor 26 to each other. As the control current I supplied to the solenoid of the variable relief valve increases, the relief set pressure (set pressure) drops, and as a result, the driving pressure of the fan motor drops. Also, the variable relief valve can be also configured so that the relief set pressure rises as the control current I becomes small.

As shown in FIG. 14A, in the storage device of the main controller 100, plural control current characteristics I0, I1, I2 are stored in a look-up table form. All of the control current characteristics I0, I1, I2 have such characteristic that the control current (target speed command signal) I drops as the target speed Nft of the cooling fan 14 increases.

The fan control section **100*h* (refer to FIG. 3) selects the control current characteristic according to a mode set by the mode setting section 100*j*. When the non-limitation mode has been set by the mode setting section 100*j*, the fan control section 100*h* selects a control current characteristic I0. When the first limitation mode has been set by the mode setting section 100*j*, the fan control section 100*h* selects a control current characteristic I1. When the second limitation mode has been set by the mode setting section 100*j*, the fan control section 100*h* selects a control current characteristic I2**.

The control current characteristic I1 is a characteristic in which the control current I becomes larger than that of the control current characteristic I0, and the control current characteristic I2 is a characteristic in which the control current I becomes larger than that of the control current characteristic I1. That is to say, when the first limitation mode has been set, the driving pressure of the fan motor 26 comes to drop compared to a case the non-limitation mode has been set, and when the second limitation mode has been set, the driving pressure of the fan motor 26 comes to drop compared to a case the first limitation mode has been set.

In the present embodiment, as an example, the control characteristic W and the control current characteristics I1, I2 are set so that the actual rotation speed of the cooling fan 14 becomes nearly equal between the flats and the high altitudes. Also, in the high altitudes where the air density ρ is low, since the heat generation amount of the engine 190 reduces compared to the flats, it is more likely that a problem does not occur even when the rotation speed of the cooling fan 14 may drop. Therefore, the control characteristic W and the control current characteristics I1, I2 may be set so that the actual rotation speed at the high altitudes becomes lower than the actual rotation speed at the flats. According to the specification of various devices mounted on the wheel loader, the control characteristic W and the control current characteristics I1, I2 may be set so that the actual rotation speed at the high altitudes becomes higher than the actual rotation speed at the flats.

The fan control section 100*h* outputs the control current (the target speed command signal for the cooling fan 14) I to the variable relief valve of the fan driving system 34, and adjusts the relief set pressure. In other words, an actual rotation speed Nfa of the cooling fan 14 is adjusted based on the control current (the target speed command signal for the cooling fan 14) I.

Figure 8:
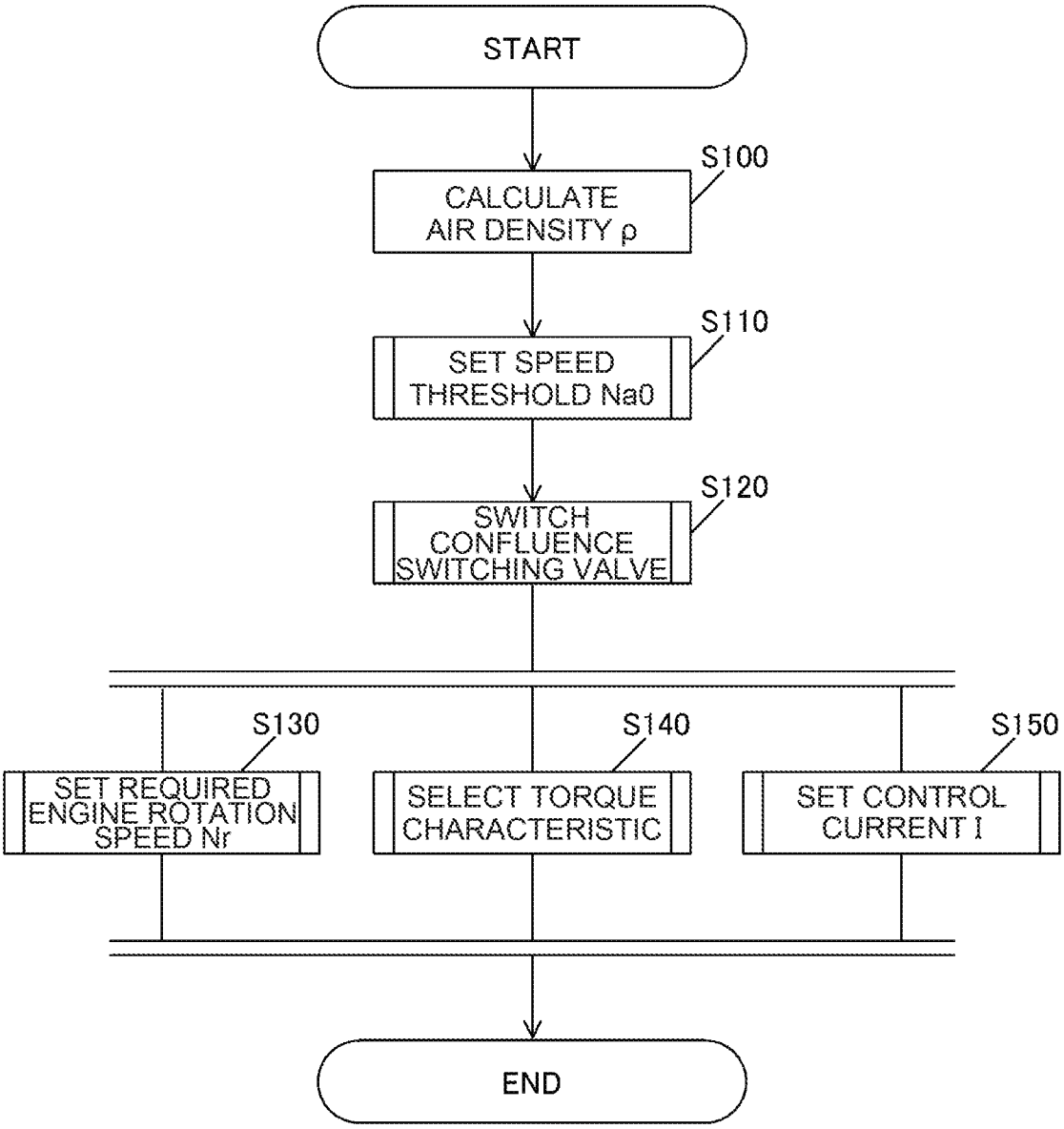
FIG. 8 is a flowchart that shows an operation of a control by the main controller.

FIG. 8 is a flowchart that shows the operation of the control by the main controller 100. The process shown in the flowchart of FIG. 8 is started by turning on an ignition switch (not illustrated) of the wheel loader, and is executed repeatedly at a predetermined control period after executing initial setting not illustrated. Further, although it is not illustrated, the main controller 100 repeatedly acquires various information such as the atmospheric pressure P detected by the atmospheric pressure sensor 160, the outside air temperature t detected by the outside air temperature sensor 161, the cooling water temperature Tw detected by the cooling water temperature sensor 27, the actual engine rotation speed Na detected by the rotation speed sensor 136 and outputted from the engine controller 15, and the manipulated variable L detected by the pedal manipulated variable sensor 134*a*.

In Step S100, the main controller 100 calculates the air density ρ of the outside air based on the atmospheric pressure P detected by the atmospheric pressure sensor 160 and the outside air temperature t detected by the outside air temperature sensor 161, and the process proceeds to Step S110.

Figure 9:
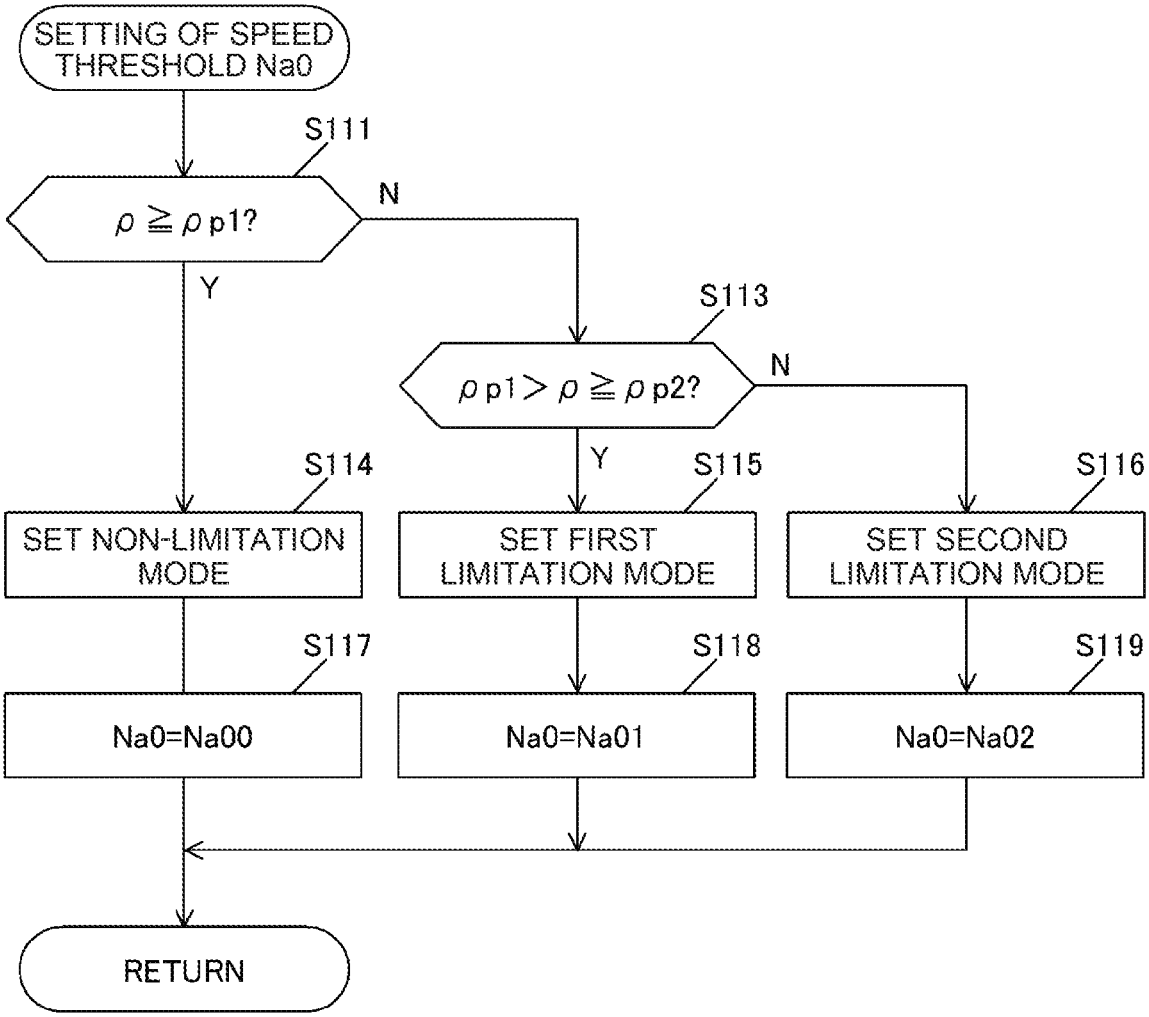
FIG. 9 is a flowchart that shows an operation of a setting control process for a speed threshold value Na0 by the main controller.

In Step S110, the main controller 100 executes setting control for the speed threshold Na0. The setting control for the speed threshold Na0 will be explained referring to FIG. 9. FIG. 9 is a flowchart that shows the operation of the setting control process for the speed threshold value Na0 by the main controller 100.

As shown in FIG. 9, in Step S111, the main controller 100 determines whether or not the air density ρ calculated in Step 100 is the first density threshold ρp1 or above. The process proceeds to Step S114 when it is determined to be affirmative in Step S111, and the process proceeds to Step S113 when it is determined to be negative in Step S111.

In Step S113, the main controller 100 determines whether or not the air density ρ calculated in Step S100 is below the first density threshold ρp1 and the second density threshold ρp2 or above. The process proceeds to Step S115 when it is determined to be affirmative in Step S113, and the process proceeds to Step S116 when it is determined to be negative in Step S113.

In Step S114, the main controller 100 sets the non-limitation mode, and the process proceeds to Step S117. In Step S115, the main controller 100 sets the first limitation mode, and the process proceeds to Step S118. In Step S116, the main controller 100 sets the second limitation mode, and the process proceeds to Step S119.

In Step S117, the main controller 100 sets the value Na00 for the speed threshold Na0, and the process returns to the main routine (refer to FIG. 8) and proceeds to Step S120. In Step S118, the main controller 100 sets the value Na0*l* for the speed threshold Na0, and the process returns to the main routine (refer to FIG. 8) and proceeds to Step S120. In Step S119, the main controller 100 sets the value Na02 for the speed threshold Na0, and the process returns to the main routine (refer to FIG. 8) and proceeds to Step S120.

Figure 10:
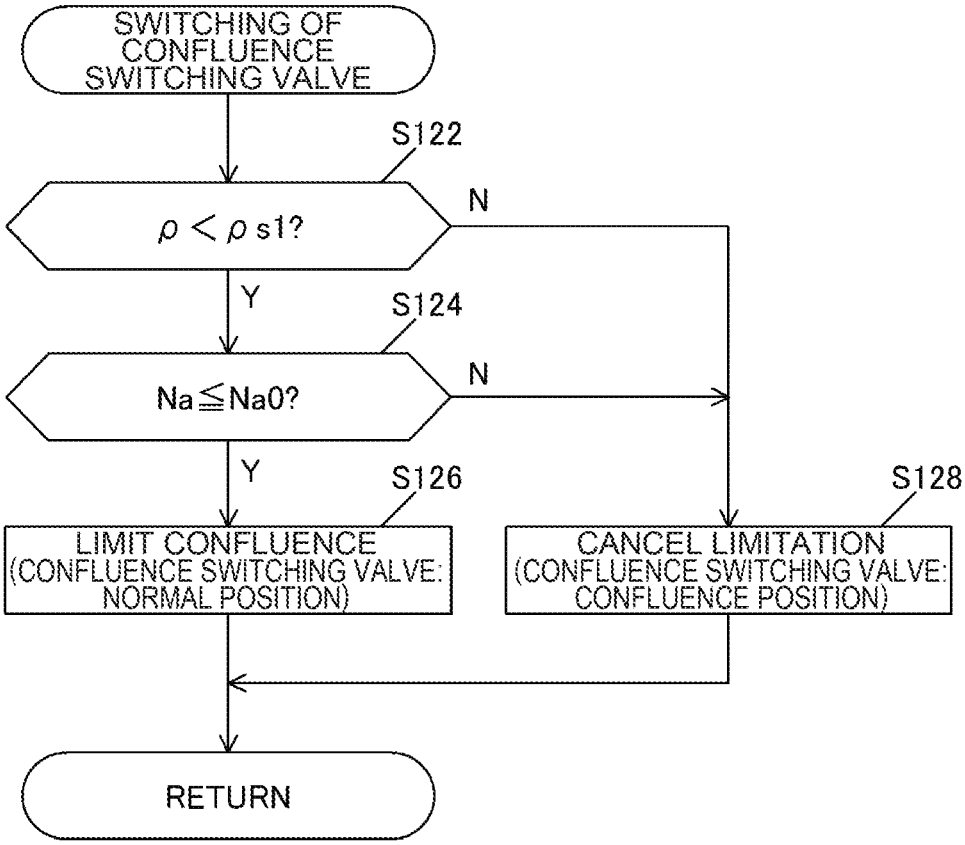
FIG. 10 is a flowchart that shows an operation of a switching control process for a confluence switching valve by the main controller.

As shown in FIG. 8, in step S120, the main controller 100 executes switching control for the confluence switching valve 33. The switching control for the confluence switching valve 33 will be explained referring to FIG. 10. FIG. 10 is a flowchart that shows the operation of the switching control process for the confluence switching valve 33 by the main controller 100.

As shown in FIG. 10, in step S122, the main controller 100 determines whether or not the air density ρ calculated in Step S100 is below the density threshold ρs1. The process proceeds to Step S124 when it is determined to be affirmative in Step S122, and the process proceeds to Step S128 when it is determined to be negative in Step S122.

In Step S124, the main controller 100 determines whether or not the actual engine rotation speed Na detected by the rotation speed sensor 136 and inputted from the engine controller 15 is the speed threshold Na0 or below. When it is determined to be affirmative in Step S124, the main controller 100 determines that the confluence limitation condition has been satisfied, and the process proceeds to Step S126. When it is determined to be negative in Step S124, the main controller 100 determines that the limitation cancellation condition has been satisfied, and the process proceeds to Step S128.

In Step S126, the main controller 100 outputs an off-signal that demagnetizes the solenoid of the confluence switching valve 33 and executes the confluence limitation control of switching the confluence switching valve 33 to the normal position, and the process returns to the main routine (refer to FIG. 8).

In Step S128, the main controller 100 outputs an on-signal that excites the solenoid of the confluence switching valve 33 and executes limitation cancellation control of switching the confluence switching valve 33 to the confluence position, and the process returns to the main routine (refer to FIG. 8).

Figure 11:
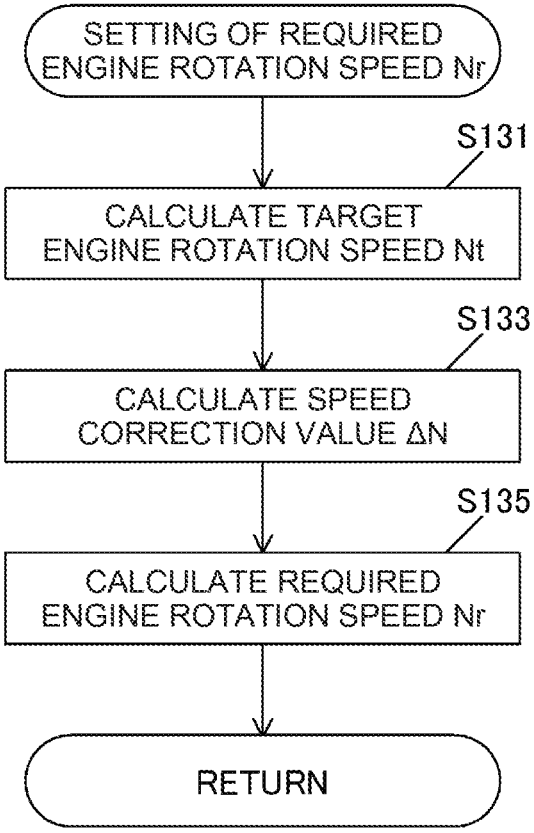
FIG. 11 is a flowchart that shows an operation of a setting control process for a required engine rotation speed Nr by the main controller.

As shown in FIG. 8, when the switching control for the confluence switching valve 33 finishes in Step S120, The processes of Steps S130, S140, S150 are executed in parallel. In Step S130, the main controller 100 executes setting control for the required engine rotation speed Nr. The setting control for the required engine rotation speed Nr will be explained referring to FIG. 11. FIG. 11 is a flowchart that shows the operation of the setting control process for the required engine rotation speed Nr by the main controller 100.

As shown in FIG. 11, in Step S131, the main controller 100 refers to the table of the characteristic Tn shown in FIG. 4 and calculates the target engine rotation speed Nt based on the manipulated variable L of the accelerator pedal 134 detected by the pedal manipulated variable sensor 134*a*, and the process proceeds to Step S133.

In Step S133, the main controller 100 refers to the table of the characteristic ΔNc shown in FIG. 5 and calculates the speed correction value ΔN based on the air density ρ calculated in Step S100, and the process proceeds to Step S135.

In Step S135, the main controller 100 calculates the required engine rotation speed Nr. The required engine rotation speed Nr is obtained by adding the target engine rotation speed Nt calculated in Step S131 and the speed correction value ΔN calculated in Step S133. The main controller 100 outputs a control signal corresponding to the required engine rotation speed Nr calculated in Step S135 to the engine controller 15, and the process returns to the main routine (refer to FIG. 8).

Figure 12:
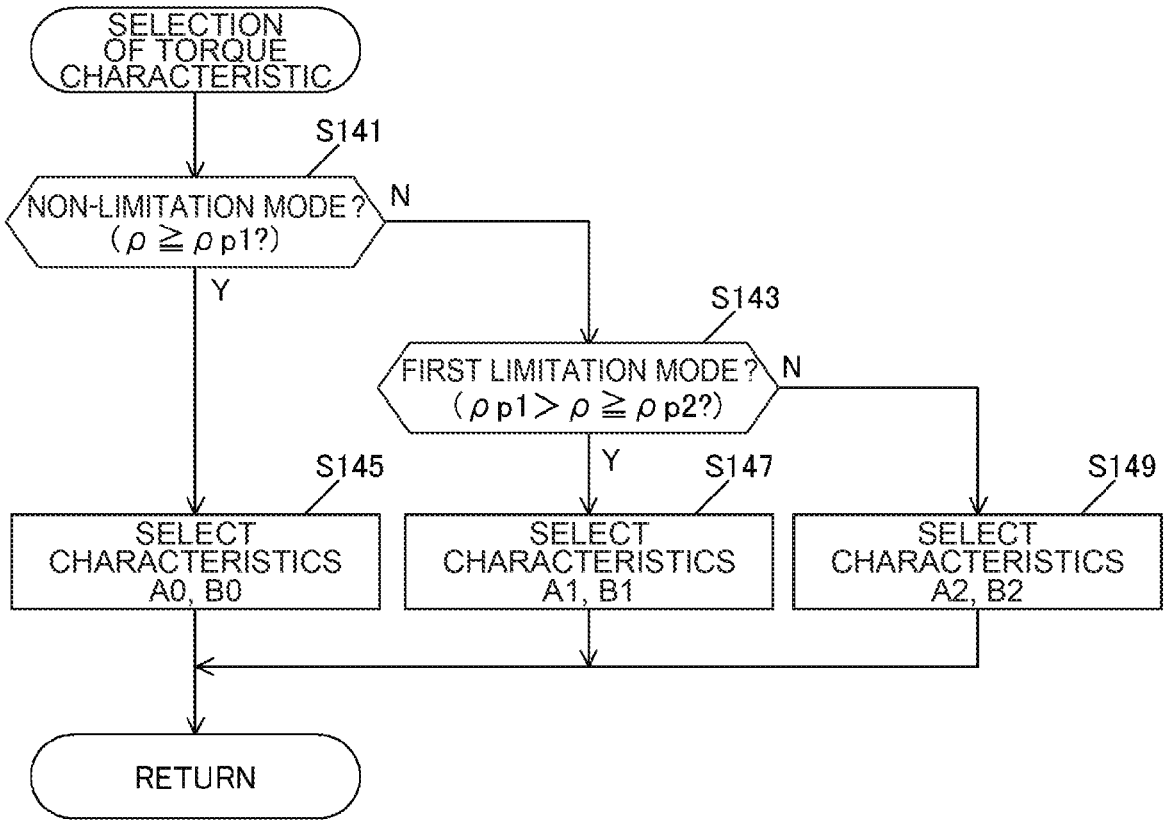
FIG. 12 is a flowchart that shows an operation of a selection control process for a torque property by the main controller.

As shown in FIG. 8, in Step S140, the main controller 100 executes selection control for the torque characteristic. The selection control for the torque characteristic will be explained referring to FIG. 12. FIG. 12 is a flowchart that shows the operation of the selection control process for the torque characteristic by the main controller 100.

As shown in FIG. 12, in Step S141, the main controller 100 determines whether or not the non-limitation mode has been set. The process proceeds to Step S145 when it is determined to be affirmative in Step S141, and the process proceeds to Step S143 when it is determined to be negative in Step S141.

In Step S143, the main controller 100 determines whether or not the first limitation mode has been set. The process proceeds to Step S147 when it is determined to be affirmative in Step S143, and the process proceeds to Step S149 when it is determined to be negative in Step S143.

In Step S145, the main controller 100 selects the characteristic A0 out of the characteristics A0, A1, A2 and selects the characteristic B0 out of the characteristics B0, B1, B2, and the process returns to the main routine (refer to FIG. 8).

In Step S147, the main controller 100 selects the characteristic A1 out of the characteristics A0, A1, A2 and selects the characteristic B1 out of the characteristics B0, B1, B2, and the process returns to the main routine (refer to FIG. 8).

In Step S149, the main controller 100 selects the characteristic A2 out of the characteristics A0, A1, A2 and selects the characteristic B2 out of the characteristics B0, B1, B2, and the process returns to the main routine (refer to FIG. 8).

Figure 15:
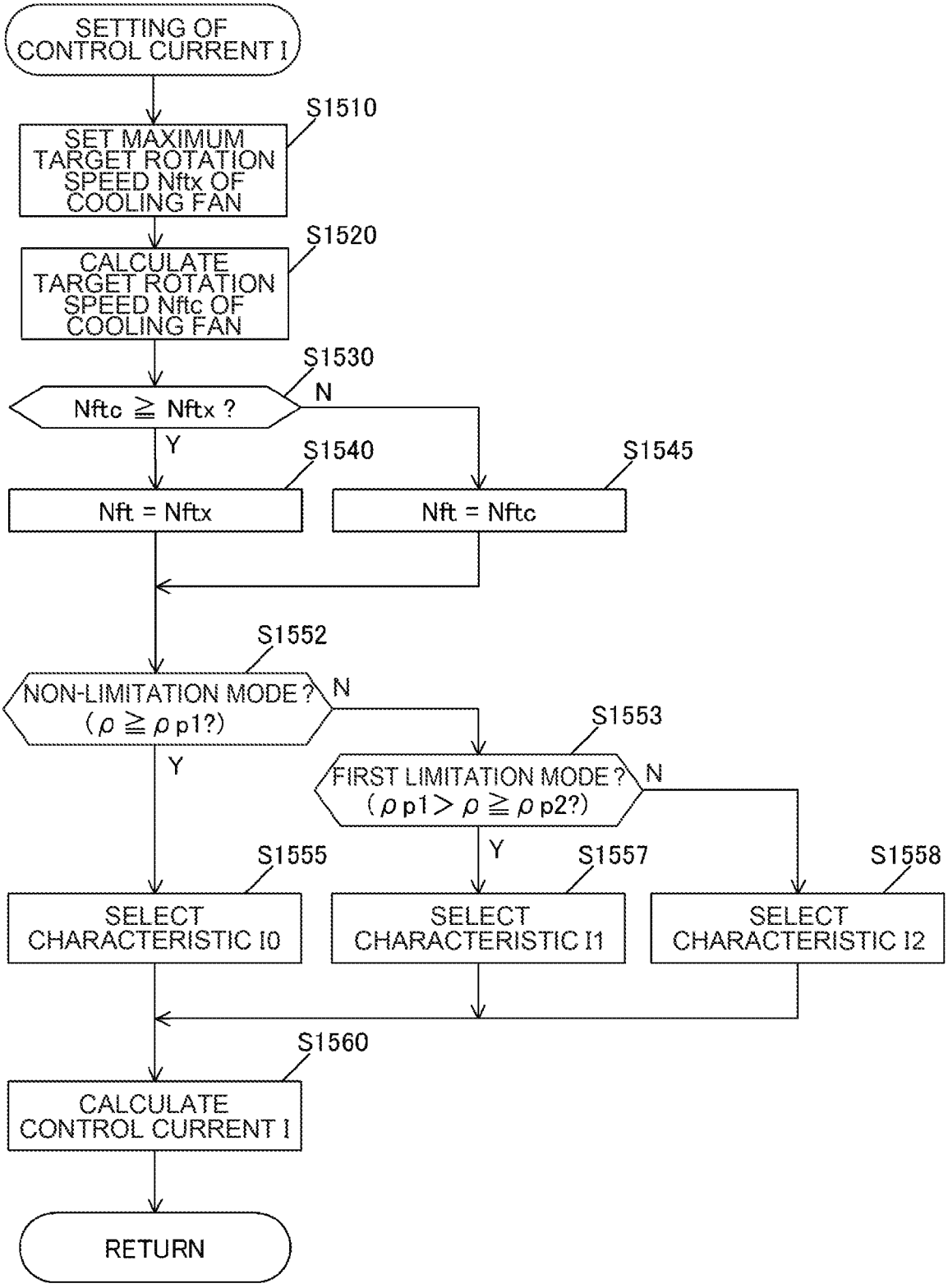
FIG. 15 is a flowchart that shows an operation of a setting control process for the control current I by the main controller.

As shown in FIG. 8, in Step S150, the main controller 100 executes setting control for the control current I. The setting control for the control current I will be explained referring to FIG. 15. FIG. 15 is a flowchart that shows the operation of the setting control process for the control current I by the main controller 100. Further, although the cooling fan 14 may be controlled taking into account the temperature of the hydraulic oil, the temperature of the working fluid of the torque converter, and so on other than the cooling water temperature Tw, in the present embodiment, an example of being controlled based on the temperature Tw of the engine cooling water detected by the cooling water temperature sensor 27 will be explained.

As shown in FIG. 15, in Step S1510, the main controller 100 refers to the table of the control characteristic W (refer to FIG. 7) and sets the maximum target rotation speed Nftx of the cooling fan 14 based on the air density ρ calculated in Step S100, and the process proceeds to Step S1520.

In Step S1520, the main controller 100 refers to the table of the control characteristic Tc (refer to FIG. 16) and calculates the target rotation speed Nftc of the cooling fan 14 based on the cooling water temperature Tw detected by the cooling water temperature sensor 27, and the process proceeds to Step S1530.

In Step S1530, the main controller 100 determines whether or not the target rotation speed Nftc is the maximum target rotation speed Nftx or above. The process proceeds to Step S1540 when it is determined to be affirmative in Step S1530, and the process proceeds to Step S1545 when it is determined to be negative in Step S1530.

In Step S1540, the main controller 100 sets the maximum target rotation speed Nftx as the target speed Nft, and the process proceeds to Step S1552. In Step S1545, the main controller 100 sets the target rotation speed Nftc as the target speed Nft, and the process proceeds to Step S1552.

In Step S1552, the main controller 100 determines whether or not the non-limitation mode has been set. The process proceeds to Step S1555 when it is determined to be affirmative in Step S1552, and the process proceeds to Step S1553 when it is determined to be negative in Step S1552.

In Step S1553, the main controller 100 determines whether or not the first limitation mode has been set. The process proceeds to Step S1557 when it is determined to be affirmative in Step S1553, and the process proceeds to Step S1558 when it is determined to be negative in Step S1553.

In Step S1555, the main controller 100 selects the characteristic I0 out of the characteristics I0, I1, I2, and the process proceeds to Step S1560. In Step S1557, the main controller 100 selects the characteristic I1 out of the characteristics I0, I2, and the process proceeds to Step S1560. In Step S1558, the main controller 100 selects the characteristic I2 out of the characteristics I0, I1, I2, and the process proceeds to Step S1560.

In Step S1560, the main controller 100 refers to a table of the control current characteristic selected (any of the characteristics I0, I1, I2 shown in FIG. 14A) and calculates the control current (target speed command signal) I based on the target speed Nft set in Step S1540 or Step S1545, and the process returns to the main routine (refer to FIG. 8).

When all process of Steps S130, S140, S150 finishes, the process shown in the flowchart of FIG. 8 is finished, and the process is executed again from Step S100 at a next control period.

According to the embodiment described above, following actions and effects are secured.

(1) The wheel loader related to the present embodiment includes the engine 190, the working device 119 that includes the bucket 112 and the arm 111, the hydraulic cylinders (115, 117) for driving the working device 119, the main hydraulic pump 11 that is driven by the engine 190 and discharges the pressure oil that is for driving the hydraulic cylinders (115, 117), the operation device 31 that operates the hydraulic cylinders (115, 117), the accessory pump 12 that is driven by the engine 190 and discharges the pressure oil that is for driving the fan device that includes the cooling fan 14, and the confluence switching valve 33 that merges the pressure oil discharged from the accessory pump 12 with the pressure oil discharged from the main hydraulic pump 11.

The main controller 100 executes confluence limitation control of reducing the confluence flow rate at the confluence switching valve 33 compared to the time when the air density ρ of the outside air is higher than the density threshold ρs1 when the air density ρ of the outside air is lower than the predetermined density threshold ρs1. The main controller 100 cancels the confluence limitation control when the actual engine rotation speed Na detected by the rotation speed sensor 136 becomes higher than the predetermined speed threshold (rotation speed value) Na0 during the confluence limitation control. Thus, according to the present embodiment, when the wheel loader is under an environment where the air density of the outside air is low such as the high altitudes, by limiting the confluence control, the load applied to the engine 190 can be reduced, and deterioration of the racing performance of the engine 190 can be suppressed. Because the racing performance (the increase rate of the engine rotation speed) of the engine 190 at the time of working at the high altitudes can be improved compared to the related arts, the working performance can be improved.

(2) The speed threshold Na0 stored in the storage device of the main controller 100 is made a higher value as the air density ρ of the outside air is lower. Therefore, as the air density ρ is lower, the timing of starting the confluence control can be delayed. As the air density ρ is lower, the output torque of the engine 190 drops, and therefore the lifting speed (loading and unloading speed) of the arm 111 and the acceleration performance of traveling drop. According to the present embodiment, since the starting timing of the confluence control can be delayed according to drop of the loading and unloading speed and the travel acceleration performance, the balance of the travel performance and the loading and unloading performance can be kept appropriately in each of plural working sites having different altitude.

(3) In the speed threshold Na0, at least the values Na01, Na02 equal to or greater than the engine rotation speed at the maximum torque point are included. The racing performance of the engine 190 can be improved sufficiently by giving priority to the acceleration performance of the engine 190 (the increase rate of the engine rotation speed) and starting the confluence control after being shifted to a state where sufficient torque can be generated at least in the low speed range of the engine 190. Particularly, when the speed threshold Na0 is set to Na02 (Na02>Nmax), priority can be given to the acceleration performance of the engine 190 in all speed range of the engine 190.

(4) The main controller 100 includes the torque characteristic setting section 100*g* that sets the pump absorption torque characteristic of the main hydraulic pump 11 based on the air density ρ of the outside air. Thereby, a load applied to the engine 190 in working at the high altitudes and the like where the air density ρ is low can be further reduced, and the racing performance of the engine 190 can be further improved. Further, also in a case the loading and unloading operation is delayed due to drop of the hydraulic load by limitation of the pump absorption torque characteristic, by adjusting the speed threshold Na0 described above, the balance of the travel performance and the loading and unloading performance can be kept appropriately.

(5) The main controller 100 includes the required speed setting section (correction section) 100*b* that corrects the rotation speed of the engine 190 so as to be increased as the air density ρ of the outside air becomes lower. By increasing the engine rotation speed at the time of working at the high altitudes compared to the time of working at the flats, occurrence of the engine stall at the low speed range is prevented and the acceleration performance of the engine 190 (the increase rate of the engine rotation speed) can be improved. As a result, the working performance can be improved.

(6) Under an environment such as the high altitudes where the air density is low, since the air resistance is less, over speed of the cooling fan 14 is concerned. In the present embodiment, the main controller 100 includes the fan control section 100*h* that lowers the maximum target rotation speed Nftx of the cooling fan 14 as the air density ρ of the outside air becomes lower. Therefore, the over speed of the cooling fan 14 at the time of working at the high altitudes can be prevented. Also, since a load applied to the engine 190 can be reduced by lowering the maximum target rotation speed Nftx of the cooling fan 14, the racing performance of the engine can be improved.

(7) Even when the control current (target speed command signal) I is determined only by the control current characteristic I0, as described above, the over speed can be prevented by lowering the maximum target rotation speed Nftx when the air density ρ is low. In the present embodiment, the main controller 100 sets the control current characteristic based on the air density ρ of the outside air. Thereby, when the air density ρ is low, since the oil pressure that controls the fan motor 26 is limited, the load consumed by the fan motor 26 can be reduced. Thus, in the present embodiment, since the control current characteristic is changed according to the air density ρ, the balance of the load of the vehicle body by the accessory pump 12 can be adjusted more effectively.

Such modifications as described below are also within the scope of the present invention, and one or a plurality of the modifications can be also combined with the embodiment described above.

(Modification 1)

Although an example of executing various controls (Steps S110, S120, S130, S140, S150) based on the air density ρ of the outside air was explained in the embodiment described above, the present invention is not limited to it. Various controls (Steps S110, S120, S130, S140, S150) may be executed based on the atmospheric pressure instead of the air density ρ of the outside air.

(Modification 1-1)

It may be configured that, when the atmospheric pressure P is lower than a predetermined threshold P1, the main controller 100 executes the confluence limitation control of reducing the confluence flow amount at the confluence switching valve 33 compared to the time the atmospheric pressure P is higher than the threshold P1. The threshold P1 is a threshold used for determining that the wheel loader is located at "the high altitudes". Also, to the speed threshold Na0, a higher value is set as the atmospheric pressure P is lower.

(Modification 1-2)

It may be configured that the main controller 100 sets the pump absorption torque characteristic of the main hydraulic pump 11 based on the atmospheric pressure P. For example, the main controller 100 selects the characteristics A0, B0 when the atmospheric pressure P is a first pressure threshold Pp1 or above (the non-limitation mode). The main controller 100 selects the characteristics A1, B1 when the atmospheric pressure P is below the first pressure threshold Pp1 and a second pressure threshold Pp2 or above (the first limitation mode). The main controller 100 selects the characteristics A2, B2 when the atmospheric pressure P is below the second pressure threshold Pp2 (the second limitation mode). Also, the magnitude relation of Pp1, Pp2 is Pp1>Pp2. The first pressure threshold Pp1 is a threshold used for determining that the wheel loader is located at "the flats", and the second pressure threshold Pp2 is a threshold used for determining that the wheel loader is located at "the high altitudes".

(Modification 1-3)

The main controller 100 may correct the rotation speed of the engine 190 so as to be increased as the atmospheric pressure P becomes lower.

(Modification 1-4)

The main controller 100 may lower the target speed (command value) for the cooling fan 14 as the atmospheric pressure P becomes lower, the target speed (command value) for the cooling fan 14 being according to the control current I.

(Modification 2)

Although the work vehicle including the bucket 112 as a working tool was explained as an example in the embodiment described above, the present invention is not limited to it. For example, the present invention may be applied to a work vehicle including a working tool such as a plough and a sweeper as the working tool.

(Modification 3)

Although an example of applying the present invention to a work vehicle transmitting the engine output to the transmission 3 through the torque converter 4 namely the so-called torque converter driving type was explained in the embodiment described above, the present invention is not limited to it. For example, the present invention may be applied to a wheel loader including HST (Hydro Static Transmission) and a wheel loader including HMT (Hydro-Mechanical Transmission).

(Modification 4)

The operation device 31 operating the control valve 21 may be of an electric type instead of the hydraulic pilot type.

(Modification 5)

The engine controller 15 may possess functions possessed by the main controller 100, and the main controller 100 may possess functions possessed by the engine controller 15. For example, instead of that the main controller 100 selects the engine output torque characteristic based on the air density ρ, the engine controller 15 may select the engine output torque characteristic based on the air density ρ. Also, the atmospheric pressure sensor 160 and the outside air temperature sensor 161 may be connected to the engine controller 15. In this case, the main controller 100 acquires information of the atmospheric pressure detected by the atmospheric pressure sensor 160 and the outside air temperature detected by the outside air temperature sensor 161 through the engine controller 15.

(Modification 6)

Although an example of selecting one value out of three values of Na00, Na01, Na02 as the speed threshold Na0 based on the air density ρ was explained in the embodiment described above, the present invention is not limited to it. It is also possible to store the relation between the speed threshold Na0 and the air density ρ in a table form or a functional form in the storage device and to calculate the speed threshold Na0 based on the air density ρ calculated.

(Modification 7)

Although an example of configuring the confluence switching valve 33 by a solenoid valve that was switched between the normal position and the confluence position was explained in the embodiment described above, the present invention is not limited to it. The confluence switching valve 33 may be configured with an electromagnetic proportional valve. When it is determined that the confluence limitation condition has been satisfied, instead of switching the confluence switching valve 33 to the normal position (shut-off position), it may be configured for example that the valve control section 100*e* retains the spool at a position where the opening of the flow passage to the confluence line 35 becomes approximately 10%. That is to say, it may be configured that the confluence flow rate is reduced to a predetermined flow rate instead of limiting the confluence flow rate to 0% when the confluence limitation condition has been satisfied.

(Modification 8)

Although an example of switching the confluence switching valve 33 to the confluence position when the limitation cancellation condition had been satisfied was explained in the embodiment described above, the present invention is not limited to it. Even when the limitation cancellation condition is satisfied, if a confluence invalidity condition is satisfied, the confluence switching valve 33 may be kept at the normal position. As the confluence invalidity condition, to be in the midst of the forward/backward switching operation, an event that the actual engine rotation speed Na is equal to or below a threshold that is set based on the required engine rotation speed Nr, an event that the temperature of the hydraulic oil and the cooling water is a predetermined threshold or above, and so on can be employed for example.

(Modification 9)

Although an example in which one characteristic out of the plural pump absorption torque characteristics B0, B1, B2 was selected based on the air density ρ was explained in the embodiment described above, the present invention is not limited to it. For example, between the characteristic B1 and the characteristic B2 and between the characteristic B0 and the characteristic B2, the characteristic may be changed continuously according to the air density ρ.

(Modification 10)

Although an example in which one characteristic out of the plural control current characteristics I0, I1, I2 was selected based on the air density ρ was explained in the embodiment described above, the present invention is not limited to it.

(Modification 10-1)

Between the characteristic I0 and the characteristic I2, the characteristic may be changed continuously according to the air density ρ.

(Modification 10-2)

Figure 14B:
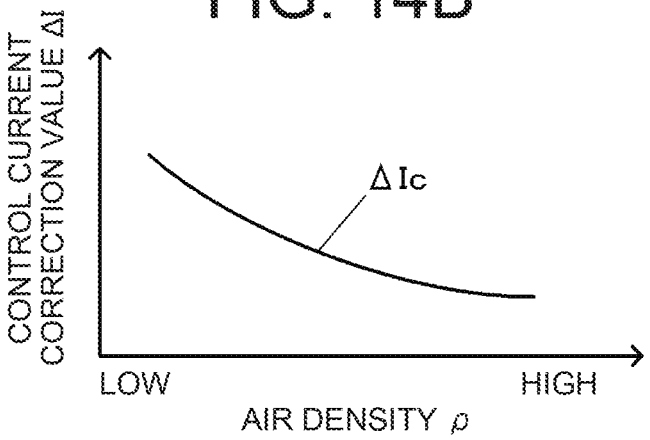
FIG. 14B is a drawing that shows a relation between the air density ρ of the outside air and a control current correction value ΔI in a work vehicle related to a modification.

The control current I may be corrected based on the air density ρ. In the present modification, a table of the control current characteristic I0 shown in FIG. 14A and a table of a characteristic ΔIc of a control current correction value ΔI with respect to the air density ρ shown in FIG. 14B are stored in the storage device of the main controller 100. The main controller 100 refers to the table of the control current characteristic I0, and calculates the control current I based on the target speed Nft of the cooling fan 14. The main controller 100 refers to the table of the control current correction characteristic ΔIc, and calculates the control current correction value ΔI based on the air density ρ. The main controller 100 calculates the control current after the correction by adding the control current correction value ΔI to the control current I, and outputs the control current (target speed command signal) after the correction to the solenoid of the variable relief valve.

(Modification 11)

Although the embodiment described above was explained with an example of the wheel loader as an example of the work vehicle, the present invention is not limited to it. For example, the present invention can be applied to various work vehicles such as a wheel excavator and a tele-handler.

Although various embodiments and alterations were explained above, the present invention is not limited to the contents of them. Other aspects conceivable within the scope of the technical thought of the present invention are to be included within the scope of the present invention.

REFERENCE SIGNS LIST

11 . . . Main hydraulic pump
12 . . . Accessory pump

14 . . . Cooling fan
26 . . . Fan motor
33 . . . Confluence switching valve
100 . . . Main controller (control device)
100*a* . . . Target speed setting section
100*b* . . . Required speed setting section (correction section)
100*c* . . . Confluence condition determination section
100*e* . . . Valve control section
100*f* . . . Threshold setting section
100*g* . . . Torque characteristic setting section
100*h* . . . Fan control section
100*i* . . . Air density calculation section
100*j* . . . Mode setting section
111 . . . Lift arm
112 . . . Bucket (working tool)
115 . . . Bucket cylinder (hydraulic cylinder)
117 . . . Arm cylinder (hydraulic cylinder)
119 . . . Working device
136 . . . Rotation speed sensor
160 . . . Atmospheric pressure sensor (atmospheric pressure detection device)
161 . . . Outside air temperature sensor (outside air temperature detection device)
190 . . . Engine

The invention claimed is:

1. A work vehicle, comprising:

an engine;

a working device that includes a work tool and a lift arm;

a hydraulic cylinder that is for driving the working device;

a main hydraulic pump that is driven by the engine and discharges pressure oil that is for driving the hydraulic cylinder;

an operation device that operates the hydraulic cylinder;

an accessory pump that is driven by the engine and discharges pressure oil that is for driving an auxiliary machine, a confluence switching valve that merges pressure oil discharged from the accessory pump with pressure oil discharged from the main hydraulic pump, wherein a rotation speed detection device, a control device are provided, the rotation speed detection device detecting rotation speed of the engine, the control device, in case atmospheric pressure or air density of outside air is lower than a predetermined value, executing confluence limitation control of reducing a confluence flow amount at the confluence switching valve compared to the time in case the atmospheric pressure or the air density of the outside air is higher than the predetermined value, and canceling the confluence limitation control in case rotation speed of the engine becomes higher than a predetermined rotation speed value during the confluence limitation control, and the rotation speed value is higher as the atmospheric pressure or the air density of the outside air is lower.

2. The work vehicle according to claim 1, wherein the rotation speed value includes at least a value equal to or greater than a rotation speed of the engine at a maximum torque point.

3. The work vehicle according to claim 1, wherein the control device includes a torque characteristic setting section that sets a pump absorption torque characteristic of the main hydraulic pump based on the atmospheric pressure or the air density of the outside air.

4. The work vehicle according to claim 1, wherein the control device includes a correction section that corrects rotation speed of the engine so as to be increased as the atmospheric pressure or the air density of the outside air becomes lower.

5. The work vehicle according to claim 1, wherein the auxiliary machine is a fan device that includes a cooling fan and a fan motor, and the control device includes a fan control section that lowers a target speed of the cooling fan as the atmospheric pressure or the air density of the outside air becomes lower.

6. The work vehicle according to claim 1, further comprising:

an atmospheric pressure detection device that detects the atmospheric pressure; and an outside air temperature detection device that detects an outside air temperature, wherein the control device includes an air density calculation section that calculates the air density of the outside air based on the atmospheric pressure detected by the atmospheric pressure detection device and the outside air temperature detected by the outside air temperature detection device.

* * * * *